US006463767B2

(12) United States Patent
Uzkureit et al.

(10) Patent No.: US 6,463,767 B2
(45) Date of Patent: Oct. 15, 2002

(54) FRONT-LOADABLE WASHING MACHINE HAVING A ROTATABLE LAUNDRY DRUM

(75) Inventors: Detlef Uzkureit; Reinhard Heyder; Thomas Wiesner; Horst Schermuck, all of Berlin (DE)

(73) Assignee: BSH Bosch und Siemens Hausgeräte GmbH, Munich (DE)

( * ) Notice: Subject to any disclaimer, the term of this patent is extended or adjusted under 35 U.S.C. 154(b) by 0 days.

(21) Appl. No.: 10/006,431

(22) Filed: Dec. 7, 2001

(65) Prior Publication Data

US 2002/0083743 A1 Jul. 4, 2002

Related U.S. Application Data

(63) Continuation of application No. PCT/EP00/04999, filed on May 31, 2000.

(30) Foreign Application Priority Data

Jun. 7, 1999 (DE) ..... 199 25 917

(51) Int. Cl.[7] ..... D06F 21/10
(52) U.S. Cl. ..... 68/58
(58) Field of Search ..... 68/58, 142, 146

(56) References Cited

U.S. PATENT DOCUMENTS 2,391,634 A * 12/1945 Lewis et al. ..... 68/58 X
2,937,516 A * 5/1960 Czaika ..... 68/58
3,385,085 A * 5/1968 Engel ..... 68/58 X

FOREIGN PATENT DOCUMENTS

| | | |
|---|---|---|
| DE | 8347 | 1/1880 |
| DE | 537758 | 10/1931 |
| DE | 576523 | 4/1933 |
| DE | 41 04 450 A1 | 8/1992 |
| DE | 44 12 718 A1 | 11/1994 |
| FR | 1 136 981 | 1/1957 |

* cited by examiner

*Primary Examiner*—Philip Coe
(74) *Attorney, Agent, or Firm*—Laurence A. Greenberg; Werner H. Stemer; Gregory L. Mayback

(57) ABSTRACT

A front-loading washing machine includes a rotatable laundry basket. The basket's lowest casing line deviates from horizontal by sloping upward toward the front when the machine is in an operating position. The basket has hollow longitudinally extended carriers disposed on the inside surface of the casing and including liquid inlets in the basket's rear area. The inlets are loaded with liquid when the basket rotates into a lowest position and direct the liquid into the carriers, which lift the liquid therein and deliver it from a lifted position into the basket's interior through openings. The basket remains easy to manufacture while ensures both rapid wetting of the laundry and at least equally good washing action. The laundry basket is mounted cylindrically around a rotational axis that slopes upward toward the front, and the carriers are slantingly disposed with regard to the basket rotation direction.

16 Claims, 3 Drawing Sheets

FRONT-LOADABLE WASHING MACHINE HAVING A ROTATABLE LAUNDRY DRUM

This application is a continuation of Ser. No. PCT/EP00/04999 filed May 31, 2000.

BACKGROUND OF THE INVENTION

Field of the Invention

The invention lies in the field of appliances. The invention relates to a front-loadable washing machine having a rotatable laundry drum, of which the lowermost casing line in the operating position of the washing machine deviates from the horizontal such that it slopes upward in the forward direction. The laundry drum has hollow, elongate paddles that are disposed on the inside of the casing and, in the rear region of the laundry drum, have liquid inlets that, during rotation of the laundry drum, in the lowermost position, have quantities of liquid admitted to them and direct the quantities of liquid into the paddles. For their part, the paddles raise quantities of liquid contained in them and discharge the same, from a raised position, through openings into the laundry-drum interior.

In the case of washing machines, for a long time the prior art has involved the practices of wetting the laundry that is to be washed with washing liquid and moving the laundry mechanically to remove the soiling. In the case of drum-type washing machines, the function is performed by a laundry drum that is disposed essentially horizontally in a tub, is intended for receiving the laundry, is made to rotate and, in the process, moves the laundry in its interior. To assist this function, the prior art has included, for some time, to dispose, inside the laundry-drum casing, elongate, rib-like paddles that are aligned transversely to the movement direction of the laundry-drum casing. Such paddles fastened on the inside of the laundry drum are disclosed in German Patent Document DE C 8 347, from 1879, and have been used for sometime now, virtually without exception, for moving the laundry in drum-type washing machines.

A number of drum-type washing machines also exist that position the paddles obliquely and run essentially along a helical line on the inside of the laundry-drum casing. The paddles are positioned obliquely in all cases with the aim of influencing the movement of the laundry and/or the introduction of mechanical energy into the laundry. Such drum-type washing machines are disclosed, for example, from German Published Patent Document DE C 537 758, German Published Patent Document DE C 576 523, French Published Patent Document FR 1 136 981 and German Published, Non-Prosecuted Patent Application DE 44 12 718 A1. Also in the prior art are drum-type washing machines having oblique positioning of the paddles causing the laundry to be transported within the drum as the drum rotates. German Utility Model 88 04 246 has a drum-type washing machine is assisted in this way for the removal of the washing.

A method of washing textiles and a fully automatic washing machine having a rotatable laundry drum is also disclosed in German Published, Non-Prosecuted Patent Application DE 41 04 450 A1. Although, therein, the lowermost casing line is not located horizontally. The paddles scoop water in the lowermost region of the tub to raise the water as the laundry drum rotates and to spray the water, from a raised position, through openings onto the laundry located therebeneath. The configuration is such that the scooped quantity of liquid is discharged before the paddles have reached a position in which they are located essentially above the laundry. The configuration slows down the wetting process to a considerable extent because the quantities of liquid discharged only run down the inner wall of the drum casing and, thus, avoid the laundry. Moreover, the truncated-cylinder laundry drum conveys the laundry inside it in the rearward direction (away from the loading opening), where it may not be reached at all by quantities of sprayed liquid. Finally, it is also difficult for the user to reach the laundry in the rear drum region.

SUMMARY OF THE INVENTION

It is accordingly an object of the invention to provide a front-loadable Washing machine having a rotatable laundry drum that overcomes the hereinafore-mentioned disadvantages of the heretofore-known devices of this general type and that improve the wetting ability of the laundry and the ability to reach the laundry.

With the foregoing and other objects in view, there is provided, in accordance with the invention, a front-loadable washing machine, including a laundry drum rotatably mounted about a rotation axis and having a casing with an interior and a lowermost casing line, a front region, and a rear region. The rotation axis slopes upward in a direction defined from the rear region to the front region. The lowermost casing line deviates from horizontal to slope upward in the direction in an operating position of the washing machine. The laundry drum has hollow, elongate paddles disposed on the interior of the casing and disposed obliquely with respect to a direction of rotation of the laundry drum. Each of the paddles have liquid inlets in the rear region of the laundry drum, the inlets fluidically communicating with the interior, discharge openings fluidically communicating with the interior for discharging scooped quantities of liquid, and a paddle interior fluidically connecting the inlets and the openings. Each of the paddles traverses over a raised position and a lowermost position during rotation of the laundry drum. The inlets admit and direct quantities of liquid into the paddles during rotation of the laundry drum while a respective one of the paddles is in the lowermost position. Each of the paddles raises the liquid contained therein and discharging the liquid through the openings into the interior while in the raised position.

The laundry drum of the invention is mounted about an axis of rotation, which slopes upward in the forward direction, and the paddles are disposed obliquely to the direction of rotation of the laundry drum. The axis of rotation of the drum, which slopes upward in the forward direction, requires the housing to be adapted correspondingly in the region of the loading opening to the effect that the loading-opening plane—oriented, as usual, perpendicularly to the axis of rotation—is likewise inclined obliquely toward the user. The configuration makes it easier to see into the laundry drum and to gain access to the laundry inside. Moreover, with a suitable direction of rotation, which may be determined by the obligatory control device of the washing machine, the paddles, which are disposed obliquely to the direction of rotation of the laundry drum, transport the laundry in the forward direction toward the loading opening. The obliquely disposed paddles likewise transport the scooped liquid in the forward direction in the same direction of rotation, with the result that, due to the axis of rotation sloping upward, the quantities of spraying liquid also descend onto items of laundry that are located further to the rear of the drum. Moreover, the paddles transport the quantities of liquid to a considerably higher level than straightforward, rectilinear paddles installed in the laundry drum. As a result, it is possible for all the quantities of liquid raised to spray over the laundry and for the wetting operation to be shortened to a considerable extent in comparison with the prior art.

In accordance with another feature of the invention, each of the paddles move, utilizing gravity, the liquid contained in the paddle interior in a direction transverse to the direction of rotation when a respective one of the paddles is raised.

Because, during the raising operation, utilizing the gravitational force, the paddles move quantities of liquid contained in their interior in a direction transverse to the direction of rotation of the laundry drum, the scooped quantities of liquid move upward to a great extent in the direction of rotation of the laundry drum, from where they reach all of the items of laundry located in the drum.

If, in accordance with a further feature of the invention, the liquid inlets are disposed in the base of the paddles, in that region of the laundry drum that extends furthest downward, most of the quantities of liquid may be scooped from a tub that encloses the laundry drum.

For the operation of the washing machine, it may be particularly advantageous if, in accordance with an added feature of the invention, the liquid inlets only act with the effect of receiving quantities of liquid into the paddles in one direction of rotation of the laundry drum. The configuration then makes it possible to achieve a particularly powerful scooping action in one direction of rotation of the laundry drum and to minimize the scooping action deliberately in another direction of rotation.

Particularly effective differences in the scooping action depending on the direction of rotation of the laundry drum can be achieved in that, in accordance with an additional feature of the invention, the liquid inlets are formed by paddle blades, which are disposed in the casing of the laundry drum and are positioned in the outward direction. Preferably, the blades are positioned in a direction extending away from the rotation axis. The alignment of the paddle blades depending on the direction of rotation of the laundry drum determines the action thereof.

The openings in the paddles here are advantageously disposed, in accordance with yet another feature of the invention, at least predominantly in that region of the extent of the paddles in which the quantities of liquid raised are to be discharged preferably into the laundry-drum interior. In the case of a cylindrical laundry drum, this is the tub section, which is located in the vicinity of the drum mounting.

In accordance with yet a further feature of the invention, the paddles are particularly advantageously curved along their extent. As a result, the spraying function can take place particularly effectively in that, with the paddle position raised, the scooped quantity of liquid is conveyed in the direction of the loading opening of the washing machine. Assuming the oblique positioning of the axis of rotation of the laundry drum, this means that the quantities of sprayed liquid descend, in part, back into the drum interior and, as such, also reach to advantageously effect the items of laundry that are located to the rear of the laundry drum. Moreover, some of the quantities of sprayed liquid also wet the window glass of the porthole door, whereby it can be made clear to the customer that, despite the small quantities of water required nowadays, his/her washing machine does actually use water.

In accordance with yet an added feature of the invention, in a manner particularly advantageous for the production process, the laundry drum is cylindrical. Cylindrical drums can be produced very much more easily and inexpensively than conical laundry drums, which may also be used for the invention. Even though conical laundry drums, within the context of the invention, may possibly be more effective and perhaps even more advantageous for handling by the customer, the cylindrical laundry drum is preferred because it is considerably easier to produce.

The scooped liquid can be transported to particularly advantageous effect from the rear to the front in an obliquely installed paddle if, in accordance with yet an additional feature of the invention, starting from the region of the liquid inlet, the paddles have a ridge line sloping upward along their extent. It may also be advantageous here if the ridge line slopes upward at an angle equal to or greater than the angle of the lowermost casing line, which deviates from the horizontal, of the laundry drum. The effect is true because, as the paddles are raised, the scooped liquid moves forward to a particularly great extent.

In tests, it has been found to be particularly advantageous for the shape of the paddles to have a profile that is at least similar to a triangle and of which one flank has a bulbous contour. The advantageous effect occurs because the other flank with the non-bulbous contour in the direction of rotation of the laundry drum that does not correspond to the preferred direction of rotation for scooping quantities of liquid can likewise transport in the upward direction quantities of liquid that are located on the inside of the drum in the dihedral angle between the flank and drum casing, and then pour over the laundry. Moreover, such a paddle shape may be advantageous for modified mechanical laundry treatment such that in one direction of rotation, in which the bulbous contour of the paddles is oriented in the direction of rotation, more sensitive laundry is not raised to such a great extent, and does not have to fall back into the bottom drum region from such a high level, as in the other direction of rotation, for less sensitive laundry, in which the steeper and planar flank contour leads.

For the ability to receive as much liquid as possible at the lowermost point of the tub, it is particularly advantageous for the paddles to have a particularly large volume at such location. In accordance with again another feature of the invention, the base of the paddles is, thus, wider in the region of the liquid inlet than at the opposite end. Although the ridge height of the paddle at the location is lower, where possible, than at the opposite end, the low liquid level means that, even at the lowermost point of the tub, it is the base width of the paddle, rather than the ridge height, which is critical.

For transporting the scooped quantities of liquid with the lowest losses within the paddle as far as the end that is directed toward the higher level of the axis of rotation, in accordance with a concomitant feature of the invention, it is particularly advantageous if openings for discharging scooped quantities of liquid are only provided in the paddles in a region of the flank that is directed toward the higher level of the axis of rotation, these being located in the preferred direction assigned to the scooping operation.

Other features that are considered as characteristic for the invention are set forth in the appended claims.

Although the invention is illustrated and described herein as embodied in a front-loadable Washing machine having a rotatable laundry drum, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
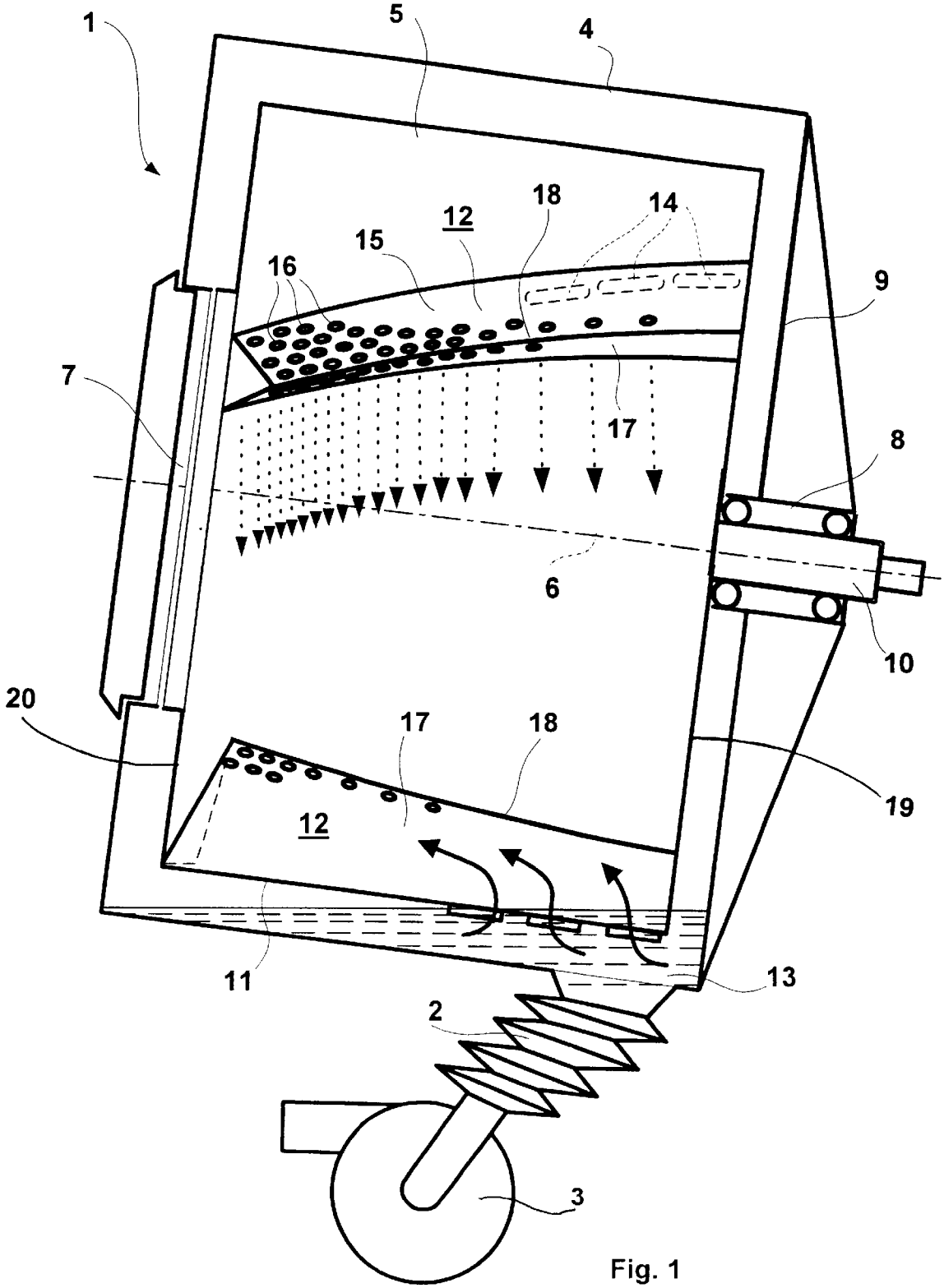
FIG. 1 is a cross-sectional view of a vibrating subassembly of a washing machine according to the invention including a tub and laundry drum.

Referring now to the figures of the drawings in detail and first, particularly to FIG. 1 thereof, there is shown a vibrating subassembly 1 of a washing machine with a corrugated hose 2 and a detergent solution pump 3 connected at the bottom.

The subassembly 1, which is suspended for vibrating action in a non-illustrated manner, essentially includes the tub 4 and the laundry drum 5 that is mounted at least more or less concentrically therein. The vibrating subassembly 1 is suspended or set up obliquely in a non-illustrated housing of the washing machine such that the axis of rotation 6 of the laundry drum 5 slopes upward at an angle of, for example, $\geqq 15°$ toward the front loading opening 7 of the tub 4. This means that the loading opening is pivoted toward the user in a user-friendly manner.

The laundry drum 5 is conventionally mounted by a stable journal 10 in a hub 8 on the rear base 9 of the tub 4. The drum 5 is cylindrical, and the bottom casing line 11 of the laundry drum 5, thus, slopes upward in the forward direction by the same angle as its axis of rotation 6. Three paddles 12 are fastened in a uniformly distributed manner on the inner casing of the drum cylinder. The paddles first serve, in a conventional manner, for raising laundry during rotation of the laundry drum 5, the laundry being processed mechanically in that, following the raising operation, the laundry falls back into the drum base again from a more or less high level and, in the process, discharges particles of dirt together with the washing liquid wetting the laundry.

The paddles 12 also serve, however, for scooping liquid, which, during the washing operation, is located in the rear bottom part of the tub 4 as a fraction, namely, the free wash liquid 13, of all the liquid located within the tub. Each paddle 12 removes fractions of the free wash liquid 13 through liquid inlets 14 whenever the relevant paddle is located at the lowermost point of its circular path. In contrast to the otherwise conventional, right-angled installation position, the paddles 12 are installed obliquely to the direction of rotation of the laundry drum 5. Moreover, they are also curved convexly in the direction of rotation of the drum. As a result, the scooped liquid is raised upward in the interior of the paddles 12 during the drum rotation and is transported in the forward direction within the paddle to the same extent as the paddle curvature slowly tips over in the forward direction during rotation.

In particular, on the convexly curved flanks 15 of the paddles, in a front region, the paddles 12 have a fair number of openings 16 for discharging the scooped quantities of liquid. In the concave flank 17, the paddles have no such openings or only a very small number of such openings, and these are also only at the front and in the very close vicinity of the ridge edge 18. The configuration makes it possible for most of the scooped quantities of liquid to pour over the items of laundry located at the front. At the same time, however, due to the oblique positioning of the axis of rotation 6, considerable amounts of the scooped quantities of liquid also come into contact with the items of laundry, which are located further to the rear of the drum 5.

Figure 2:
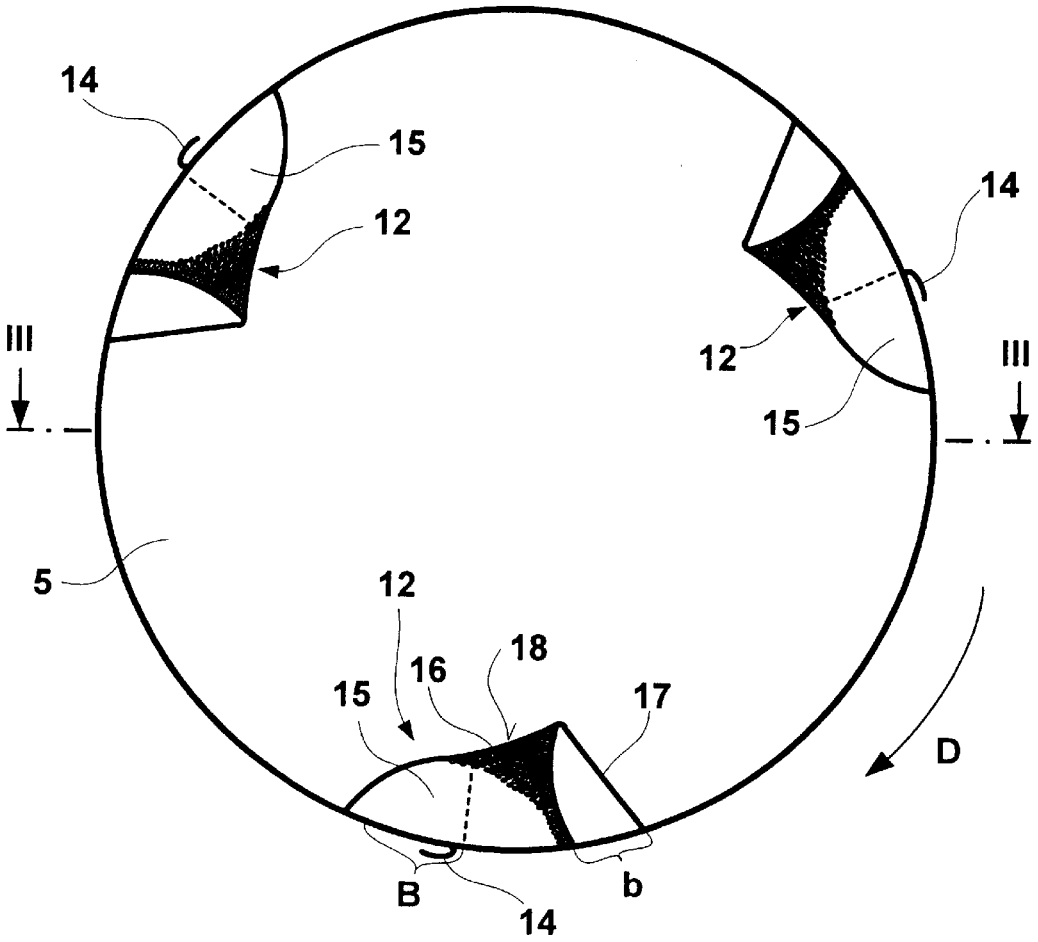
FIG. 2 is a front elevational view in a direction toward a rear base of the laundry drum of FIG. 1 having paddles configured according to the invention.

The view into the laundry drum 5, which is illustrated in FIG. 2, shows the configuration and the shape of the paddles 12 more clearly. It can be seen therefrom that the ridge line 18 of the paddles is curved and is spaced apart from the drum by casing by a smaller distance at the rear end of the paddles 12 than at the front end. It can also be seen that the width B of the paddle base at the rear end is greater than the width b at the front end. The cross-section of each paddle 12 is essentially triangular; the bulbous shape of the convex flanks 15 produces a curved triangular side. In the example, the openings 16 for emptying the paddles 12 are only provided on the convex flank 15.

Figure 3:
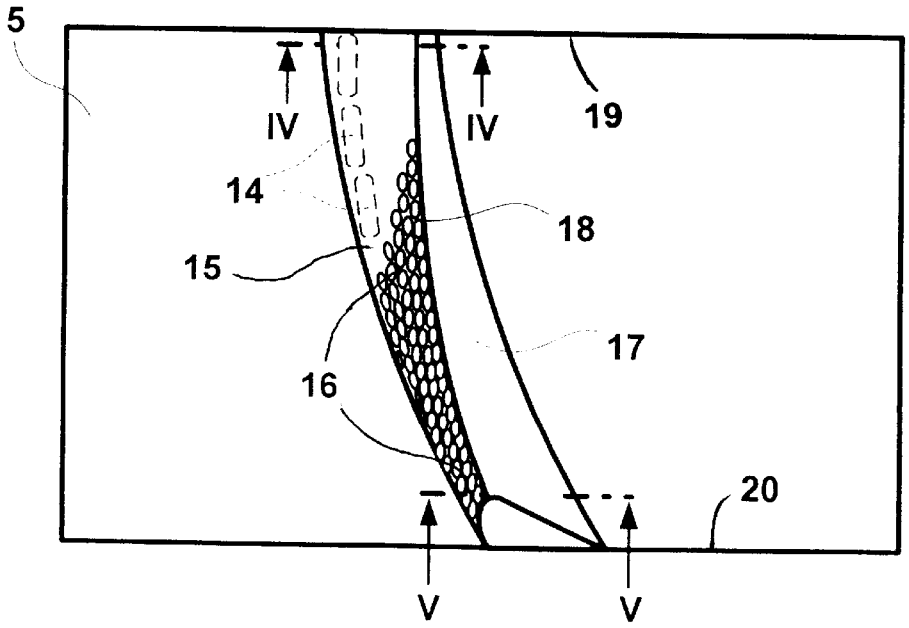
FIG. 3 is a cross-sectional view through the laundry drum of FIG. 2 along section line III—III.

From the view of the paddle 12 from above in the sectional illustration of FIG. 3, it can also clearly be seen that the uninterrupted, concave flank 17 is steeper in the vicinity of the rear wall 19 of the drum than in the vicinity of the front wall 20 of the drum and than the convex flank 15 in the vicinity of the rear wall 19 of the drum. The convex flank 15 correspondingly runs in the opposite direction to the concave flank 17.

Figure 4:
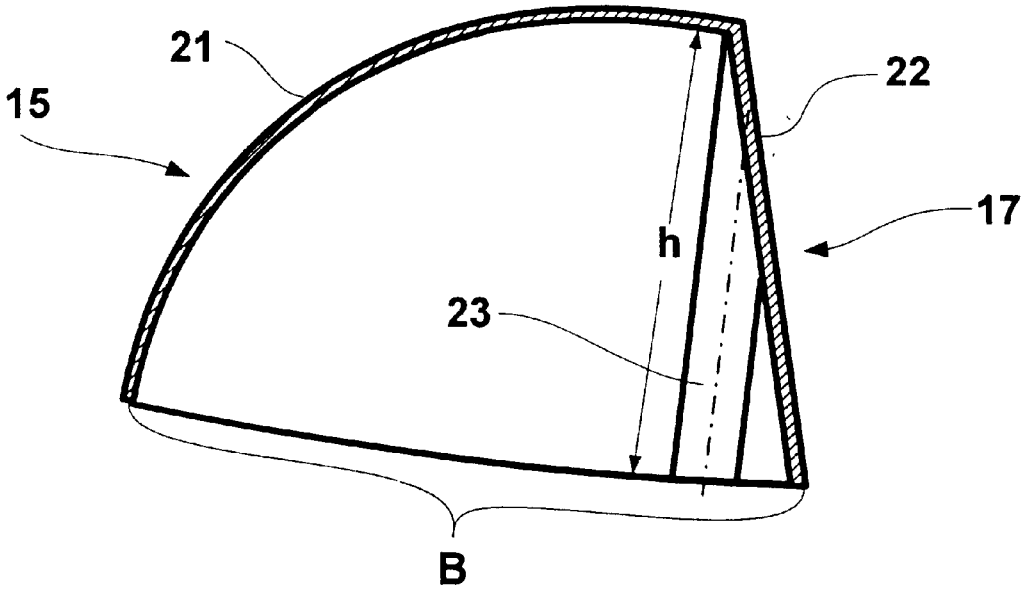
FIG. 4 is a cross-sectional view through the paddle of FIG. 3 a long section line IV—IV.
Figure 5:
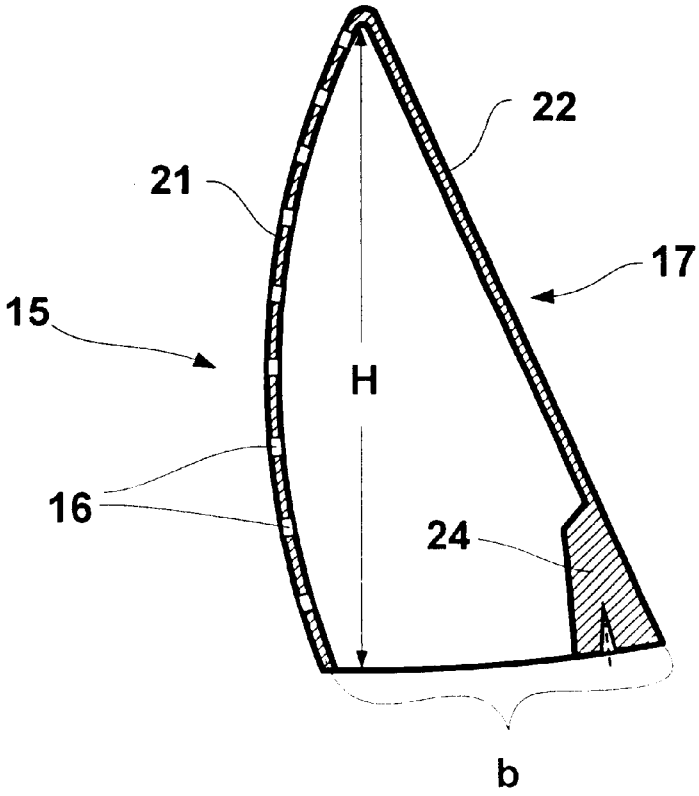
FIG. 5 is a cross-sectional view through the paddle of FIG. 3 along section line V—V.

However, the essential difference between the two flanks 15 and 17 (FIGS. 4 and 5) is that the flank 15 has curved meridian lines 21 in contrast to the concave flank 17, which has rectilinear meridian lines 22. The configuration can be seen particularly clearly in the two sectional illustrations of FIGS. 4 and 5. The shaping has the task, in particular, of causing the more sensitive laundry to be raised not quite as far as is possible and advantageous for normal laundry (e.g. cottons), in that the sensitive laundry falls back into the bottom drum region from a lower level and is, thus, subjected to lower mechanical loading than normal laundry. The respectively preferred directions of rotation are then controlled correspondingly: sensitive laundry—bulbous paddle contour in front, less sensitive laundry—non-bulbous paddle contour in front. FIG. 4 shows the triangular section through a paddle 12 in the vicinity of the rear wall 19 of the drum, and FIG. 5 shows the same in the vicinity of the front wall 20 of the drum. Preferably, the paddles 12 are injection molded from plastic and, in their interior, have a sufficient number of fastening domes 23 and 24, into which self-tapping plastic screws can be screwed. The paddles 12 are fastened on the casing of the laundry drum 5 as a result.

We claim:

1. A front-loadable washing machine, comprising:

a laundry drum rotatably mounted about a rotation axis and having:

a casing with an interior and a lowermost casing line;

a front region; and a rear region;

said rotation axis sloping upward in a direction defined from said rear region to said front region;

said lowermost casing line deviating from horizontal to slope upward in said direction in an operating position of the washing machine;

said laundry drum having hollow, elongate paddles disposed on said interior of said casing and disposed obliquely with respect to a direction of rotation of said laundry drum;

each of said paddles having:

liquid inlets in said rear region of said laundry drum and fluidically communicating with said interior;

openings fluidically communicating with said interior for discharging scooped quantities of liquid; and a paddle interior fluidically connecting said inlets and said openings;

each of said paddles traversing over a raised position and a lowermost position during rotation of said laundry drum;

said inlets admitting and directing quantities of liquid into said paddles during rotation of said laundry drum while a respective one of said paddles is in said lowermost position; and each of said paddles raising the liquid contained therein and discharging the liquid through said openings into said interior while in said raised position.

2. The washing machine according to claim 1, wherein each of said paddles move, utilizing gravity, the liquid contained in said paddle interior in a direction transverse to said direction of rotation when a respective one of said paddles is raised.

3. The washing machine according to claim 1, including a tub enclosing said laundry drum, said laundry drum having a lowermost region, each of said paddles having a base disposed in said lowermost region, and said inlets being disposed in said base.

4. The washing machine according to claim 3, wherein each of said paddles has:

an end opposite said base; and said base is wider than said opposite end.

5. The washing machine according to claim 1, wherein:

said laundry drum rotates about said axis in two directions; and said inlets receive the liquid into said paddles in only one of said two directions.

6. The washing machine according to claim 1, wherein:

said inlets are formed by paddle blades; and said blades are disposed in said casing.

7. The washing machine according to claim 6, wherein said blades are positioned in a direction extending away from said axis.

8. The washing machine according to claim 1, wherein said openings are substantially disposed in a region of said paddles in which the raised liquid is to be discharged into said interior of said casing.

9. The washing machine according to claim 1, wherein said paddles are curved along an extent thereof.

10. The washing machine according to claim 1, wherein said laundry drum is cylindrical.

11. The washing machine according to claim 1, wherein:

said laundry drum has a central outer region; and starting from a region of said inlets on a respective one of said paddles, each of said paddles has a ridge line sloping along an extent thereof in an inward direction defined from said central outer region towards said axis.

12. The washing machine according to claim 11, wherein:

said lowermost casing line deviates from horizontal at a given angle; and said ridge line slopes at an angle greater than or equal to said given angle of said lowermost casing line in said inward direction.

13. The washing machine according to claim 1, wherein said paddles have a triangular-like profile with a flank having a bulbous contour.

14. The washing machine according to claim 13, wherein:

said rotation axis has a higher level; and said openings are only provided in said paddles in a region of said flank directed toward said higher level.

15. The washing machine according to claim 14, wherein:

said laundry drum rotates about said axis in two directions including a preferred direction;

said preferred direction is associated with scooping of the liquid into said paddles;

said inlets receive the liquid into said paddles in only said preferred direction; and said openings are located on said paddles to receive the liquid when said laundry drum rotates in said preferred direction.

16. The washing machine according to claim 1, wherein each of said paddles has:

an end opposite a region of said inlets; and a base wider in said region of said inlets than at said opposite end.

* * * * *